US009717280B2

(12) United States Patent
Truong

(10) Patent No.: US 9,717,280 B2
(45) Date of Patent: Aug. 1, 2017

(54) ADJUSTABLE COLLAR STAY FOR MEN AND WOMEN'S APPAREL

(71) Applicant: Michael Truong, Chicago, IL (US)

(72) Inventor: Michael Truong, Chicago, IL (US)

( * ) Notice: Subject to any disclaimer, the term of this patent is extended or adjusted under 35 U.S.C. 154(b) by 0 days.

(21) Appl. No.: 15/140,119

(22) Filed: Apr. 27, 2016

(65) Prior Publication Data

US 2017/0020202 A1 Jan. 26, 2017

Related U.S. Application Data

(63) Continuation of application No. 14/102,996, filed on Dec. 11, 2013, now abandoned.

(51) Int. Cl.
*A41B 3/06* (2006.01)
*A41B 3/00* (2006.01)

(52) U.S. Cl.
CPC ..... *A41B 3/06* (2013.01)

(58) Field of Classification Search
CPC .... A41B 3/06; A41B 3/08; A41B 3/00; A41B 1/14
See application file for complete search history.

(56) References Cited

U.S. PATENT DOCUMENTS 443,023 A 12/1890 Weir
892,604 A 7/1908 Meehan
962,665 A 6/1910 Quigley
1,233,860 A 7/1917 Finkelstein
1,235,454 A 7/1917 Finkelstein
1,413,470 A 4/1922 Getsinger
1,826,176 A 10/1931 Hutchison
1,879,918 A 9/1932 Steele
2,089,748 A 8/1937 Herscovitch
2,110,525 A 3/1938 Kass
2,155,065 A 4/1939 Steele
2,275,098 A 3/1942 Welch
2,423,776 A 7/1947 Humpola
2,487,284 A 11/1949 Thomas
2,964,756 A 12/1960 Liebowitz
3,060,447 A 10/1962 Dethier
4,118,803 A 10/1978 Blau
4,286,337 A 9/1981 Malouf, Jr.
4,434,512 A 3/1984 Hansen
4,922,553 A 5/1990 Morrone
4,975,983 A 12/1990 Everett
5,626,267 A 5/1997 Peruski
6,089,422 A 7/2000 Gibson
(Continued)

*Primary Examiner* — Bobby Muromoto, Jr.
(74) *Attorney, Agent, or Firm* — Cardinal Law Group

(57) ABSTRACT

Embodiments relate to an apparatus and method for holding a shirt collar in a position and orientation on a shirt front. The apparatus includes a first elongate collar stay adapted for attachment to an inside surface of the shirt collar or positionable within a collar stay pocket of the shirt collar, the first elongate collar stay having a first adherence portion for removable contact with inside surface of the shirt collar or the collar stay pocket; and a second elongate collar stay moveably connected to the first elongate collar stay, the second elongate collar stay adapted for attachment to an outside surface of the shirt opposite the inside surface of the shirt collar and in relation thereto, the second elongate collar stay having a second adherence portion for removable contact with the outside surface of the shirt opposite the inside surface of the collar and in relation thereto.

17 Claims, 11 Drawing Sheets

(56) References Cited

U.S. PATENT DOCUMENTS

| | | | |
|---|---|---|---|
| 6,708,344 | B2 | 3/2004 | Friendman |
| 6,748,602 | B1 | 6/2004 | Barnes |
| 6,889,387 | B1 | 5/2005 | Tiss et al. |
| 7,004,361 | B2 | 2/2006 | Thomas |
| 7,409,730 | B2 | 8/2008 | Boos |
| 7,653,950 | B2 | 2/2010 | Johnson |
| 8,108,948 | B2 | 2/2012 | Boos |
| 8,296,865 | B2 | 10/2012 | Garcia |
| 2003/0226188 | A1 | 12/2003 | Siu |
| 2005/0066425 | A1 | 3/2005 | Kozlarek |
| 2005/0160520 | A1 | 7/2005 | Forrest |
| 2006/0218695 | A1 | 10/2006 | Boos |
| 2007/0277293 | A1 | 12/2007 | Koepp |
| 2008/0047984 | A1 | 2/2008 | Keeter |
| 2010/0313331 | A1 | 12/2010 | English |
| 2011/0145974 | A1 | 6/2011 | Hookano |

ADJUSTABLE COLLAR STAY FOR MEN AND WOMEN'S APPAREL

CROSS REFERENCE TO RELATED APPLICATION

This application is a continuation-in-part of application Ser. No. 14/102,996 filed Dec. 11, 2013, the complete subject matter of which is incorporated herein by reference.

FIELD OF THE INVENTION

The present invention is in the technical field of fashion accessories; specifically adjustable collar stays to provide form and structure to ones collar.

BACKGROUND OF THE INVENTION

Fashion has been an integral part of society for centuries worldwide. Men and women have taken pride and have paid close attention to detail, the outfits and clothing accessories they select, since to a majority of men and women, what they wear, represents who they are as individuals. A garment of clothing on its own may be a simple shirt, or a pair of pants, but collectively assembled, and worn in a certain way creates a fashion trend which ultimately can make a statement.

Certain types of apparel such as shirts, dresses, and blouses have collars. Through the course of time, the collar starts to lose its structure and rigidness giving it a flat wore out appearance.

Individuals enjoy having a sharp looking collar with structure and form to add to their sense of style, helping them make a statement. This type of collar can also complement and enhance the overall look of an outfit if the individual is layering and wearing a sports coat or jacket over their collared garment. A sharp, rigid collar with form can also increase ones level of confidence in multiple settings whether in the office or in a social setting.

Collar stays are made of various materials (metal, plastics, horn, etc), are smooth, rigid, and normally rounded at one end, while pointed at the other, are inserted into specifically made pockets on the underside of a shirt collar to provide support for the collar points. Although this provides a straight collar point, it still doesn't help in forming that perfect angled collar that one prefers.

SUMMARY OF THE INVENTION

One embodiment relates to an apparatus for holding a shirt collar in a position and orientation on a shirt front, comprising a first portion adapted for attachment to an inside surface of the shirt collar or positionable within a collar stay pocket of the shirt collar, the first portion having a first adherence portion for removable contact with inside surface of the shirt collar or the collar stay pocket; and a second portion moveably connected to the first portion, the second portion adapted for attachment to an outside surface of the shirt opposite the inside surface of the shirt collar and in relation thereto; and at least one of the first portion and the second portion having an adherence portion for removable contact with inside surface of the shirt collar, the collar stay pocket and/or the outside surface of the shirt opposite the inside surface of the shirt collar and in relation thereto.

Another embodiment relates to an apparatus for holding a shirt collar in a position and orientation on a shirt front, comprising a first elongate collar stay adapted for attachment to an inside surface of the shirt collar or positionable within a collar stay pocket of the shirt collar, a second elongate collar stay moveably connected to the first elongate collar stay, the second elongate collar stay adapted for attachment to an outside surface of the shirt opposite the inside surface of the shirt collar and in relation thereto; and at least one of the first elongate collar stay and the second elongate collar stay having an adhesive for removable contact with at least one of the inside surface of the shirt collar or the collar stay pocket.

Still another embodiment relates to a method for attaching a shirt collar in a position and orientation to a shirt front using an apparatus. The method comprising positioning the first elongate collar stay on the shirt collar; adhering the first elongate to the shirt collar; positioning the second elongate collar stay to an outside surface of the shirt opposite the inside surface of the shirt collar and in relation thereto; and adhering the second elongate collar stay to the outside surface of the shirt.

Another embodiment relates to an apparatus for holding a shirt collar in a position and orientation on a shirt front. The apparatus includes a first portion having opposing ends adapted for attachment to an inside surface of the shirt collar or the shirt front, the first portion having a first adherence portion for removable contact with inside surface of the shirt collar or the collar stay pocket, a long edge and short edge opposite the long edge, the first portion defining a first plane. A connector is coupled to the first portion at one of the opposing ends, the connector formed at about a 45 degree angle to the long edge of the first portion. A second portion is formed at about a 90 degree angle to the first portion on the same plane as the first portion, the second portion having opposing ends, one end of the second portion being coupled to the connector, the second portion adapted for attachment to an inside surface of the shirt collar or the shirt front, the second portion further including a long edge and short edge opposite the long edge, such that the second portion moves about the connector from a first position on the first plane to a plurality of positions on planes different from the first plane. At least one of the first portion and the second portion have an adherence portion for removable contact with an inside surface of the shirt collar, a collar stay pocket and/or the outside surface of the shirt opposite the inside surface of the shirt collar and in relation thereto.

Another embodiment relates to an apparatus for holding a shirt collar in a position and orientation on a shirt front. The apparatus includes a first portion having a first long edge and defining a first plane. A second portion is formed at a right angle to the first portion on the same plane as the first portion, the second portion further having a long edge. A connector is coupled to an end of the first portion and the second portion, the connector formed at about a 45 degree angle to the long edges of the first portion and the second portion. The second portion moves about the connector from a first position on the first plane to second position on a plane different from the first plane and a third position on a plane substantially similar to the first plane. Opposing ends are adapted for attachment to an inside surface of the shirt collar or the shirt front, the first portion having a first adherence portion for removable contact with inside surface of the shirt collar or the collar stay pocket.

Still another embodiment relates to an apparatus for holding a shirt collar in a position and orientation on a shirt front. A first portion has at least one end, a long edge and a short edge opposite the long edge, the first portion defining a first plane. A second portion has at least one end, a long edge and a short edge opposite the long edge, the second portion at a right angle to the first portion on the first plane. A connector is coupled to at the end of the first portion and the end of the second portion so that the long end of the first portion contacts the long end of the second portion and the short end of the first portion contacts the short end of the second portion. The connector is formed at about a 45 degree angle to the long edges of the first portion and the second portion, so that the second portion moves about the connector from a first position on the first plane to second position on a plane different from the first plane and a third position on a plane substantially similar to the first plane. Opposing ends are adapted for attachment to an inside surface of the shirt collar or the shirt front, the first portion having a first adherence portion for removable contact with inside surface of the shirt collar or the collar stay pocket.

The foregoing and other features and advantages of the invention will become further apparent from the following detailed description of the presently preferred embodiment, read in conjunction with the accompanying drawings. The drawings are not to scale. The detailed description and drawings are merely illustrative of the invention rather than limiting, the scope of the invention being defined by the appended claims and equivalents thereof.

BRIEF DESCRIPTION OF THE DRAWINGS

Throughout the various figures, like reference numbers refer to like elements.

DETAILED DESCRIPTION OF PRESENTLY PREFERRED EMBODIMENTS

Figure 1A:
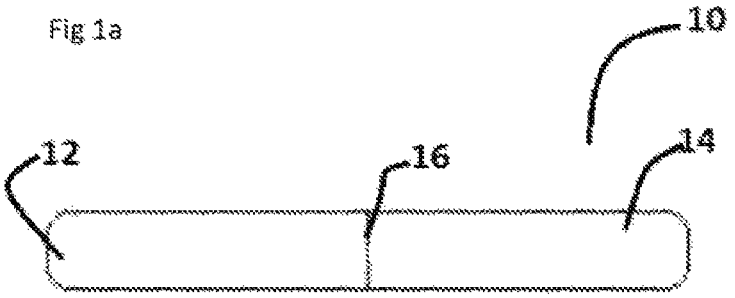
FIGS. 1A-1B illustrate front and back views of a collar stay apparatus in accordance with one embodiment of the present invention.
Figure 1B:
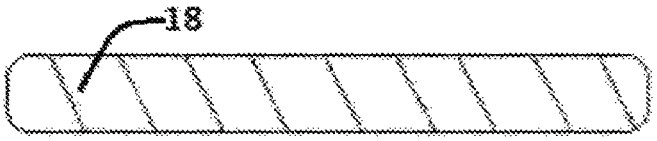

FIGS. 1A-1B illustrate front and back views of a collar stay apparatus, generally designated 10, for holding a shirt collar in a position and orientation on a shirt front in accordance with one embodiment. In at least one embodiment, the apparatus 10 includes a first portion 12 adapted for attachment to an inside surface of the shirt collar or positionable within a collar stay pocket of the shirt collar. The apparatus 10 further includes a second portion 14 moveably connected to the first portion 12 via moveable connector 16, where the second portion 14 is adapted for attachment to an outside surface of the shirt opposite the inside surface of the shirt collar and in relation thereto.

In at least one embodiment, at least one of the first portion 12, the second portion 14, or both have an adherence portion attached thereto. FIG. 1B illustrates the first portion 12 having an opposing first adherence portion 18 for fixed or removable attachment to an inside surface of the shirt collar or positionable within a collar stay pocket of the shirt collar. The second portion 14 has an opposing second adherence portion for fixed or removable attachment to an outside surface of the shirt opposite the inside surface of the shirt collar and in relation thereto. The first portion and the second portion cooperatively engage for substantially limiting relative movements of the shirt collar with respect to the shirt.

FIGS. 1A-1B illustrate the first portion 12 and second portion 14 as elongated collar stays. Although an elongated stay is shown, other designs and shapes may be contemplated including, but not limited to a square design when folded consisting of two triangles, a rectangular design when folded consisting of two squares, and the like. Further, while the adherence portion may comprise an adhesive, other embodiments including but not limited to double face tape, a tacky material, mucilage and the like may be used. The first portion, the second portion or both may be made of the same or different material, selected from a material including but not limited to metal, stainless steel, plastic, horn, and the like.

Figure 2A:
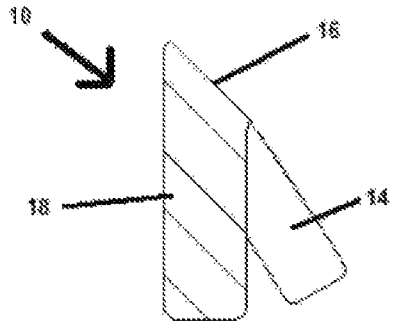
FIG. 2A illustrates the collar stay of FIG. 1A-1B bent in accordance with one embodiment of the present invention.
Figure 2B:
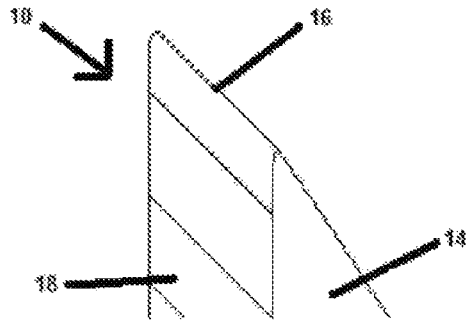
FIG. 2B illustrates an enlarged view of the bend of FIG. 2A in accordance with one embodiment of present invention.

As illustrated in FIG. 1A, the apparatus 10 includes a moveable connector 16 coupling the first portion 12 and second portion 14. The moveable connector 16 may comprises a bendable portion or weakened portion, and the like. Embodiments may include at least one of the first portion and the second portion comprised of a flexible material adapted to bend in response to the arrangement of the shirt collar and outside surface of the shirt. FIG. 1 depicts the moveable connector 16 located along a transverse axis such the first portion 12 and second portion 14 are substantially equal. However, the moveable connector 16 may be positioned anywhere along the apparatus such that the first portion 12 and second portion 14 are of unequal lengths. Further, the moveable connector 16 may be located along the longitudinal or any other axis with the first and second portions being of equal or different dimensions. FIG. 2A illustrates the apparatus or collar stay 10 bent in accordance with one embodiment of the present invention. FIG. 2B illustrates an enlarged view of the moveable connector or bend 16 of FIG. 2A in accordance with one embodiment of present invention.

Figure 3:
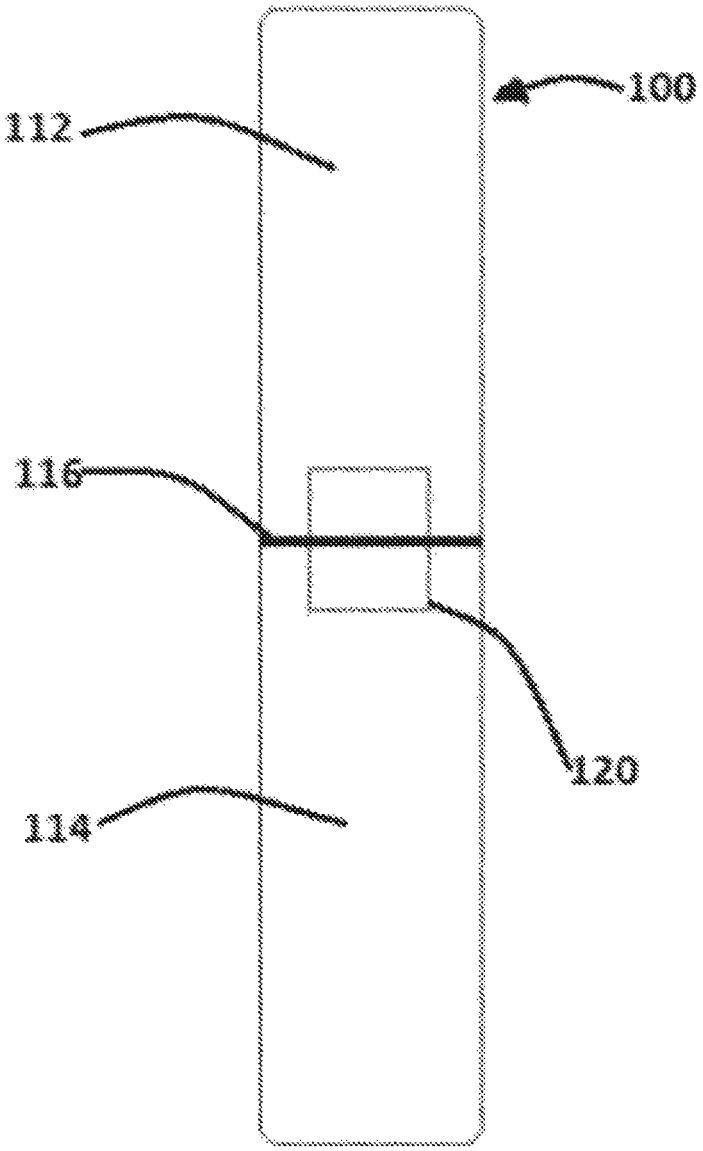
FIG. 3 illustrates aback view of the collar stay apparatus of FIG. 1A-1B in accordance with another embodiment of the present invention.

FIG. 3 illustrates a back view of a collar stay apparatus, generally designated 100, for holding a shirt collar in a position and orientation on a shirt in accordance with another embodiment. In at least one embodiment, the apparatus 100 includes a first portion 112 adapted for attachment to an inside surface of the shirt collar or positionable within a collar stay pocket of the shirt collar. The apparatus 100 further includes a second portion 114 moveably connected to the first portion 112 via moveable connector 116, where the second portion 114 is adapted for attachment to an outside surface of the shirt opposite the inside surface of the shirt collar and in relation thereto. In the illustrated embodiment, the apparatus 100 includes a substantially rigid flap or filament 120 adapted to keep the apparatus 100 in a fixed position.

In at least one embodiment, at least one of the first portion 112, the second portion 114, or both have an adherence portion attached thereto. In this embodiment the first portion 112 has an opposing first adherence portion for fixed or removable attachment to an inside surface of the shirt collar or positionable within a collar stay pocket of the shirt collar. The second portion 114 has an opposing second adherence portion for fixed or removable attachment to an outside surface of the shirt opposite the inside surface of the shirt collar and in relation thereto. The first portion and the second portion cooperatively engage for substantially limiting relative movements of the shirt collar with respect to the shirt.

Figure 4:
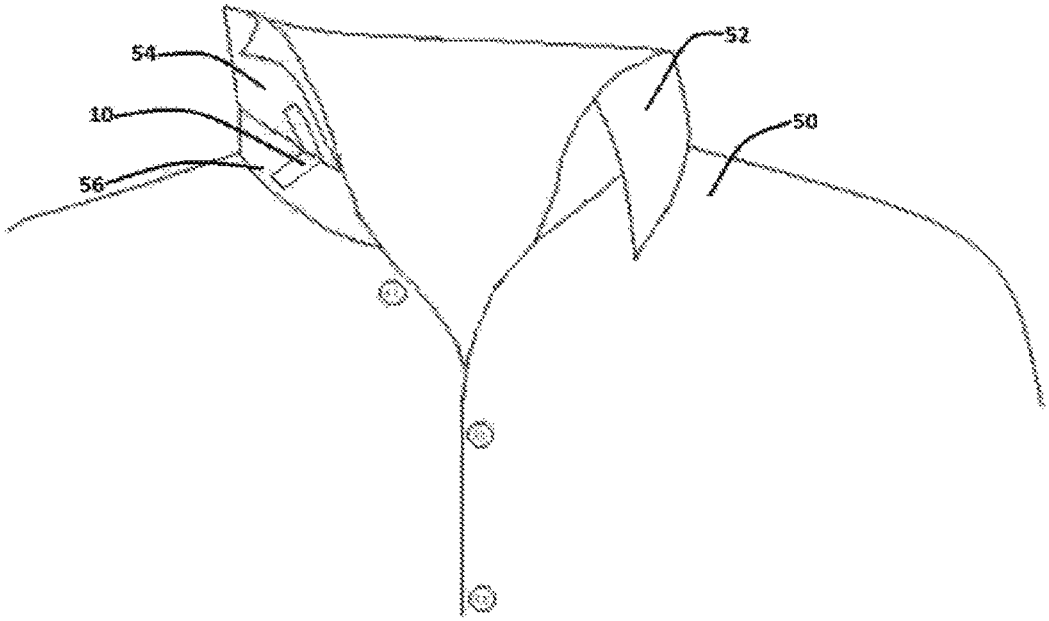
FIG. 4 illustrates a shirt and collar using a collar stay apparatus of FIG. 1A-1B in accordance with one embodiment.
Figure 5:
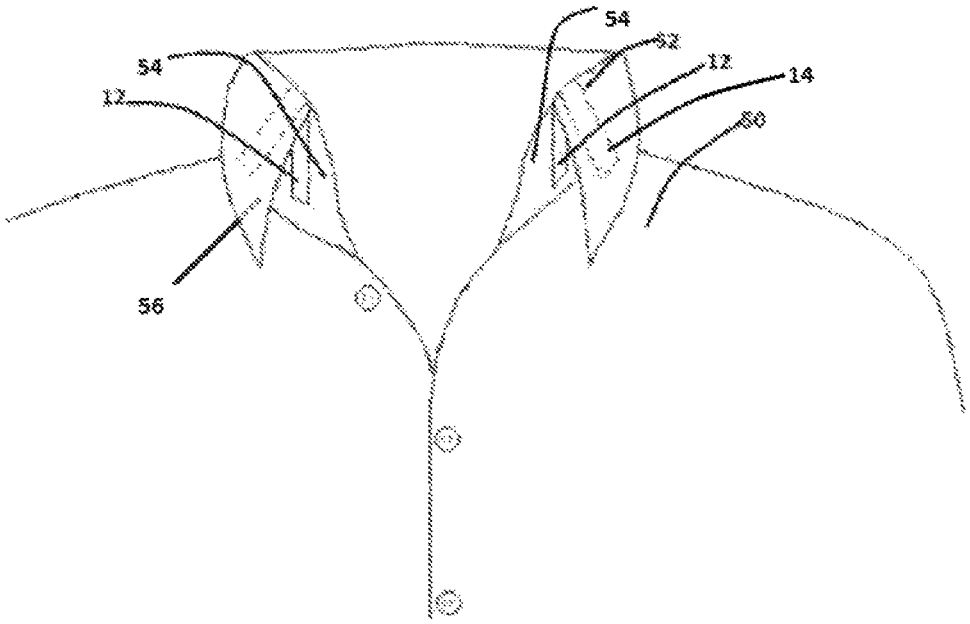
FIG. 5 illustrates a shirt and collar using a collar stay apparatus of FIG. 1A-1B in accordance with one embodiment.

FIGS. 4 and 5 illustrate a shirt 50 and collar 52 having an inside surface 54 and outside surface 56 using a collar stay apparatus 10/100 in accordance with one embodiment of the present invention. FIG. 4 illustrates the collar 52 in up position to receive the collar stay apparatus 10/100. FIGS. 4-5 illustrate the apparatus 10/100 includes the first portion 12/112 adapted for attachment to an inside surface 54 of the collar 52 or positionable within a collar stay pocket of the collar 52, while the second portion 14/114 is adapted for attachment to an outside surface 56 of the shirt 50 opposite the inside surface 54 of the shirt collar 52 and in relation thereto, the first portion 12/112 and the second portion 14/114 cooperatively engage for substantially limiting relative movements of the shirt collar 52 with respect to the shirt 50.

Yet another embodiment relates to a method for attaching a shirt collar 52 in a position and orientation to a shirt 50 front using an apparatus 10/100. The method includes positioning the first portion 12/112 on the shirt collar 52; and adhering the first portion 12/112 to the shirt collar 52. The method includes positioning the second elongate collar stay to an outside surface 56 of the shirt 50; and adhering the second portion 14/114 to the outside surface 56 of the shirt 50. In at least one embodiment, positioning the first portion 12/112 includes positioning the first portion 12/112 on an inside surface 54 of the shirt 50 and adhering the first portion 12/112 elongate to the inside surface 54 of the shirt collar 52; and/or inserting the first portion 12/112 into a collar stay pocket of the shirt collar 52; and adhering the first portion to the collar stay pocket using the first tacky portion. Bending the shirt collar 52 so that the first portion 12/112 and the second portion 14/114 are covered by the shirt collar 52.

Figure 6:
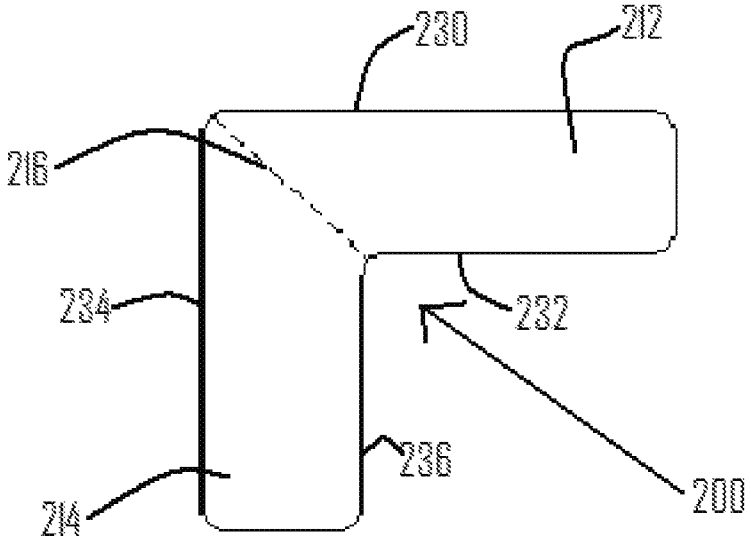
FIG. 6 illustrates a front view of a collar stay apparatus in accordance with another embodiment of the present invention.

FIG. 6 illustrates a collar stay apparatus, generally designated 200, for holding a shirt collar in a position and orientation on a shirt front in accordance with one embodiment. In the illustrated embodiment the apparatus 200 includes a first portion 212 having opposing ends, a long edge 230 and short edge 232 opposite the long edge 230, the first portion 212 defining a first plane. The first portion 212 may include an adherence portion for removable contact with an inside surface of the shirt collar, the shirt front and/or the collar stay pocket.

The apparatus 200 further includes a second portion 214 formed at about a 90 degree angle to the first portion 212 and on the same plane as the first portion 212. The second portion 214 has opposing ends, a long edge 234 and short edge 236 opposite the long edge 234. The second portion 214 may include an adherence portion for removable contact with inside surface of the shirt collar, the shirt front and/or the collar stay pocket. At least one of the first portion 212 and the second portion 214 is selected from the material comprising at least metal, stainless steel plastic, horn, combinations thereof and the like.

FIG. 6 illustrates apparatus 200 further includes a connector 216 coupled to or connecting each of the first portion 212 and 214 at one of the opposing ends of each portion. In at least one embodiment, the connector 216 is formed at about a 45 degree angle to the long edge 230, the long edge 234 or both the long edge 230 and the long edge 234. In at least one embodiment, the connector 216 comprises a bendable portion moveably connecting the first portion 212 to the second portion 214, where the bendable portion comprises a cut or dimple. In at least one embodiment, the second portion 214 is adapted to move about the connector 216 from a first position on the first plane to a plurality of positions on planes different from the first plane.

Figure 7:
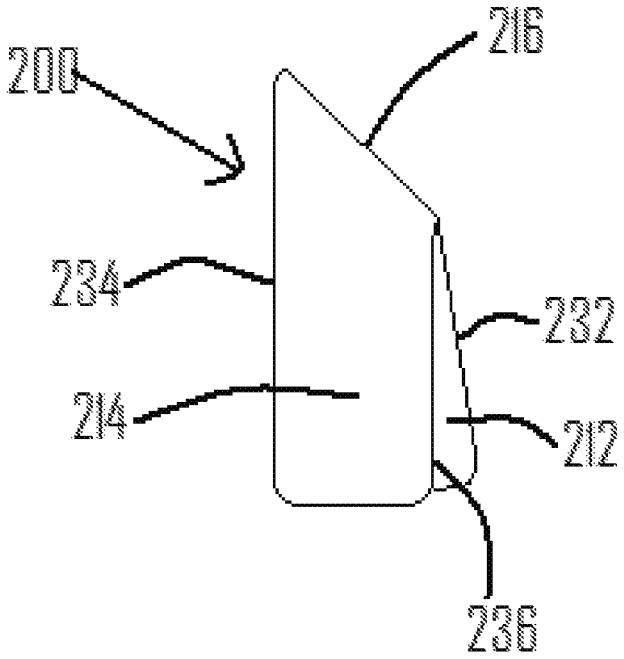
FIG. 7 illustrates the collar stay of FIG. 6 bent in accordance with an embodiment of the present invention.

FIG. 7 illustrates the apparatus 200 configured for use, where the second portion 214 is adapted to move about the connector 216 from a first position on the first plane to a position on a plane different from the first plane. In the illustrated embodiment, long edge 230 is proximate long edge 234 (not shown) and short edge 232 is proximate short edge 236.

Figure 8:
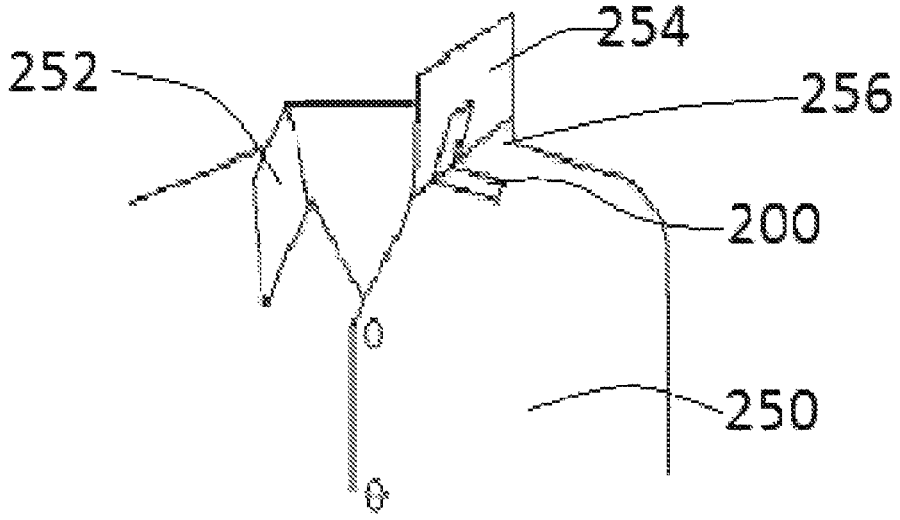
FIG. 8 illustrates a shirt and collar using a collar stay apparatus of FIGS. 6-7 in accordance with an embodiment.

FIG. 8 illustrates a shirt 250 with a shirt collar using the collar stay apparatus 200 of FIGS. 6-7. The shirt 250 has an outside surface 256 and the shirt collar has an outside surface 252 and an inside surface 254. FIG. 8 illustrates the apparatus 200 engaging the shirt 250 and shirt collar. More specifically, FIG. 8 illustrates the first portion 212 and the second portion 214 cooperatively engage the inside surface 254 of the shirt collar and the outside surface 256 of the shirt opposite the inside surface 254 of the shirt collar, substantially limiting relative movements of the shirt collar with respect to the shirt 250. In at least one embodiment, the opposing ends of apparatus 200 is adapted for attachment to an inside surface 254 of the shirt collar or the outside surface 258 of the shirt 250, the first portion 212 and/or the second portion 214 having an adherence portion for removable contact with inside surface 254 of the shirt collar and/or the collar stay pocket.

Figure 9:
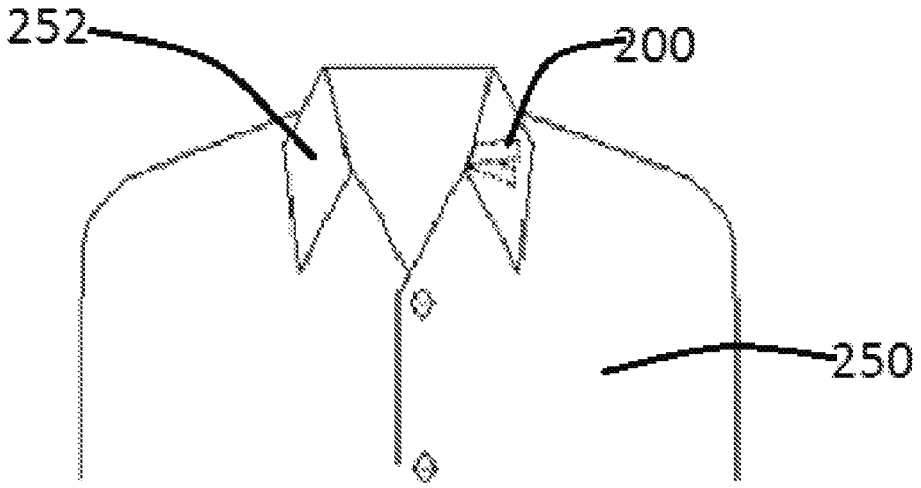
FIG. 9 illustrates the shirt and collar of FIG. 8 using a collar stay apparatus of FIGS. 6-7 (shown in phantom) in accordance with one embodiment.

FIG. 9 illustrates the shirt 250 of FIG. 8 using the collar stay apparatus 200 of FIGS. 6-7. FIG. 9 illustrates the shirt collar folded down with the shirt 250 ready for wear. FIG. 9 depicts the collar stay apparatus 200 (shown in phantom) such that the apparatus 200 is not seen when the collar is folded down.

Figure 10:
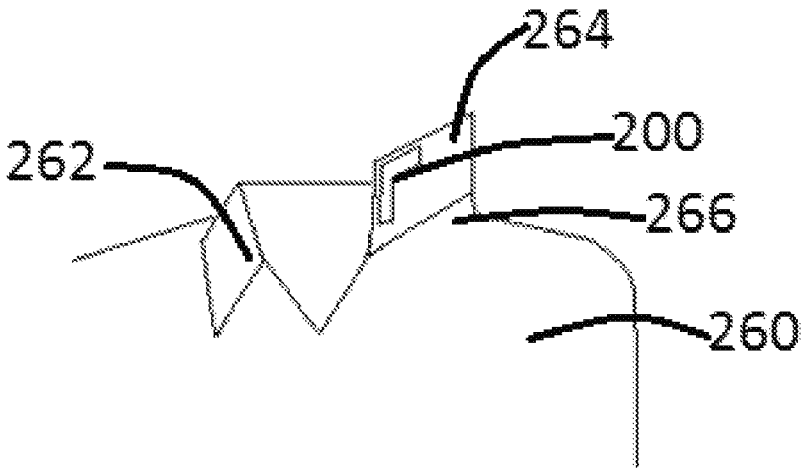
FIG. 10 illustrates another shirt and collar using a collar stay apparatus of FIGS. 6-7 in accordance with another embodiment.

FIG. 10 illustrates another shirt 260 with a shirt collar (more commonly referred to as a polo shirt) using the collar stay apparatus 200 of FIGS. 6-7. The shirt 260 has an outside surface 266 and the shirt collar has an outside surface 262 and an inside surface 264. FIG. 10 illustrates the apparatus 200 engaging the shirt collar. More specifically, FIG. 10 illustrates both the first portion 212 and the second portion 214 cooperatively engage the inside surface 264 of the shirt collar, preventing the shirt collar from rolling with respect to the shirt 260.

Figure 11:
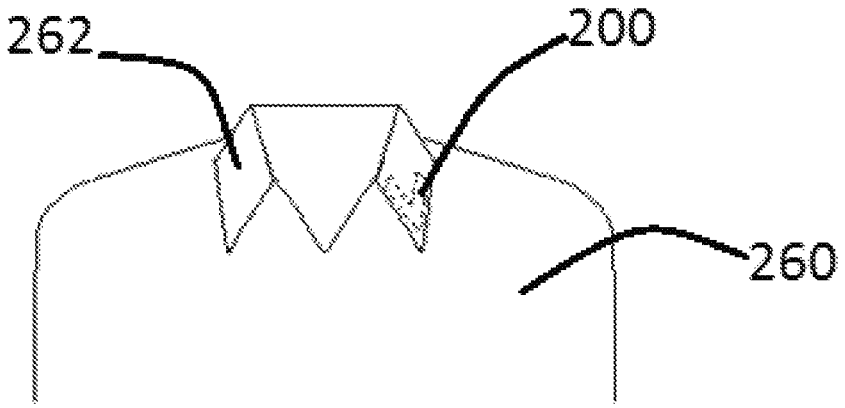
FIG. 11 illustrates the shirt and collar of FIG. 9 using a collar stay apparatus of FIGS. 6-7 (shown in phantom) in accordance with one embodiment.

FIG. 11 illustrates the shirt 260 of FIG. 10 using the collar stay apparatus 200 of FIGS. 6-7. FIG. 11 illustrates the shirt collar folded down with the shirt 260 ready for wear. FIG. 11 depicts the collar stay apparatus 200 (shown in phantom) such that the apparatus 200 is not seen when the collar is folded down and the shirt collar is prevented from rolling.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

The invention claimed is:

1. An apparatus for holding a shirt collar in a position and orientation on a shirt front, comprising:

a first portion having opposing ends adapted for attachment to an inside surface of the shirt collar or the shirt front, the first portion having a first adherence portion for removable contact with inside surface of the shirt collar or the collar stay pocket, a long edge and short edge opposite the long edge, the first portion defining a first plane;

a connector coupled to the first portion at one of the opposing ends, the connector formed at about a 45 degree angle to the long edge of the first portion;

a second portion formed at about a 90 degree angle to the first portion on the same plane as the first portion, the second portion having opposing ends, one end of the second portion being coupled to the connector, the second portion adapted for attachment to an inside surface of the shirt collar or the shirt front, the second portion further including a long edge and short edge opposite the long edge, the second portion moving about the connector from a first position on the first plane to a plurality of positions on planes different from the first plane; and at least one of the first portion and the second portion having an adherence portion for removable contact with an inside surface of the shirt collar, a collar stay pocket and/or the outside surface of the shirt opposite the inside surface of the shirt collar and in relation thereto.

2. The apparatus of claim 1, wherein the connector comprises a bendable portion moveably connecting the first portion to the second portion.

3. The apparatus of claim 2, wherein the bendable portion comprises a cut or dimple.

4. The apparatus of claim 1, wherein the first portion and the second portion cooperatively engage the inside surface of the shirt collar and the outside surface of the shirt opposite the inside surface of the shirt collar for substantially limiting relative movements of the shirt collar with respect to the shirt.

5. The apparatus of claim 1, wherein the first portion and the second portion cooperatively engage the inside surface of the shirt collar to prevent the shirt collar from rolling.

6. The apparatus of claim 1, wherein at least one of the first portion and the second portion is selected from the material comprising at least metal, stainless steel plastic, horn, combinations thereof, and the like.

7. An apparatus for holding a shirt collar in a position and orientation on a shirt front, comprising:

a first portion having a first long edge and defining a first plane;

a second portion formed at a right angle to the first portion on the same plane as the first portion, the second portion further having a long edge;

a connector coupled to an end of the first portion and the second portion, the connector formed at about a 45 degree angle to the long edges of the first portion and the second portion, the second portion moving about the connector from a first position on the first plane to second position on a plane different from the first plane and a third position on a plane substantially similar to the first plane; and opposing ends adapted for attachment to an inside surface of the shirt collar or the shirt front, the first portion having a first adherence portion for removable contact with inside surface of the shirt collar or the collar stay pocket.

8. The apparatus of claim 7, wherein the connector comprises a bendable portion moveably connecting the first portion to the second portion.

9. The apparatus of claim 8, wherein the bendable portion comprises a cut or dimple.

10. The apparatus of claim 8, wherein the first portion and the second portion cooperatively engage the inside surface of the shirt collar and the outside surface of the shirt opposite the inside surface of the shirt collar for substantially limiting relative movements of the shirt collar with respect to the shirt.

11. The apparatus of claim 9, wherein the first portion and the second portion cooperatively engage the inside surface of the shirt collar to prevent the shirt collar from rolling.

12. The apparatus of claim 7, wherein at least one of the first portion and the second portion is selected from the material comprising at least metal, stainless steel plastic, horn; combinations thereof and the like.

13. An apparatus for holding a shirt collar in a position and orientation on a shirt front, comprising:

a first portion having at least one end, a long edge and a short edge opposite the long edge, the first portion defining a first plane;

a second portion having at least one end, a long edge and a short edge opposite the long edge, the second portion at a right angle to the first portion on the first plane;

a connector coupled to at the end of the first portion and the end of the second portion so that the long end of the first portion contacts the long end of the second portion and the short end of the first portion contacts the short end of the second portion, the connector formed at about a 45 degree angle to the long edges of the first portion and the second portion, the second portion moving about the connector from a first position on the first plane to second position on a plane different from the first plane and a third position on a plane substantially similar to the first plane; and opposing ends adapted for attachment to an inside surface of the shirt collar or the shirt front, the first portion having a first adherence portion for removable contact with inside surface of the shirt collar or the collar stay pocket.

14. The apparatus of claim 13, wherein the connector comprises a bendable portion moveably connecting the first portion to the second portion.

15. The apparatus of claim 14, wherein the bendable portion comprises a cut or dimple.

16. The apparatus of claim 13, wherein the first portion and the second portion cooperatively engage the inside surface of the shirt collar and the outside surface of the shirt opposite the inside surface of the shirt collar for substantially limiting relative movements of the shirt collar with respect to the shirt.

17. The apparatus of claim 13, wherein the first portion and the second portion cooperatively engage the inside surface of the shirt collar to prevent the shirt collar from rolling.

* * * * *